US007082646B2

(12) United States Patent
Trivedi et al.

(10) Patent No.: US 7,082,646 B2
(45) Date of Patent: Aug. 1, 2006

(54) REVOLVING FLATS CLEANING BRUSHING AND RESHARPENING APPARATUS IN A CARDING MACHINE

(75) Inventors: Mehul Kunjbihari Trivedi, Pune (IN); Bankim Ishwarlal Mistry, Pune (IN); Ashok Kumar Pal, Pune (IN)

(73) Assignee: The Indian Card Clothing Co., Ltd. (IN)

( * ) Notice: Subject to any disclaimer, the term of this patent is extended or adjusted under 35 U.S.C. 154(b) by 26 days.

(21) Appl. No.: 10/897,094

(22) Filed: Jul. 23, 2004

(65) Prior Publication Data

US 2005/0034278 A1 Feb. 17, 2005

(30) Foreign Application Priority Data

Jul. 24, 2003 (GB) ..... 0317402.6

(51) Int. Cl.
*D01G 15/02* (2006.01)

(52) U.S. Cl. ..... 19/102; 19/111

(58) Field of Classification Search ..... 19/102, 19/111, 113, 104, 107, 108, 109; 15/256.53, 15/256.51, 312.1
See application file for complete search history.

(56) References Cited

U.S. PATENT DOCUMENTS

| | | | | |
|---|---|---|---|---|
| 1,363,094 | A | 12/1920 | Draper | |
| 4,368,561 | A * | 1/1983 | Trutzschler | 19/111 |
| 4,759,102 | A * | 7/1988 | Verzilli et al. | 19/111 |
| 4,771,514 | A * | 9/1988 | Verzilli | 19/109 |
| 5,259,092 | A | 11/1993 | Lambe et al. | |
| 6,106,381 | A * | 8/2000 | Leder et al. | 451/416 |
| 6,129,614 | A * | 10/2000 | Faas et al. | 451/184 |
| 6,167,594 | B1 * | 1/2001 | Steinert | 19/111 |
| 6,226,837 | B1 * | 5/2001 | Leder et al. | 19/111 |
| 6,314,620 | B1 * | 11/2001 | Leder et al. | 19/102 |
| 6,353,972 | B1 * | 3/2002 | Berner | 19/102 |
| 6,431,969 | B1 * | 8/2002 | Sauter et al. | 451/416 |
| 6,508,698 | B1 * | 1/2003 | Faas | 451/526 |

FOREIGN PATENT DOCUMENTS

| | | |
|---|---|---|
| GB | 239608 | 9/1925 |
| GB | 770767 | 3/1957 |
| GB | 1198936 | 7/1970 |
| GB | 1429899 | 3/1976 |

* cited by examiner

*Primary Examiner*—Gary L. Welch
(74) *Attorney, Agent, or Firm*—Buchanan Ingersoll PC

(57) ABSTRACT

An apparatus for on card cleaning and grinding of revolving flats (4) in a carding machine is disclosed. The apparatus mounts an interchangeable rotary cleaning brush (14) or grinding wheel (16) on a wheel drive (11) so that the wheel can be spun around an axis lateral to the path of the revolving flats (4). During a carding operation the height of the cleaning brush (14) is accurately adjusted by a precision feeding mechanism so that the brush cleans down to the surface of the revolving flats of the revolving flats (4) and so cleans and polishes the wires (4*b*) and the fouling which commonly accumulates beneath the points (4*c*) of the wires. The brush (14) can readily be replaced by a grinding wheel with a peripheral grinding surface. The height of the grinding wheel can be accurately set by the use of the precision feeding mechanism so that the wires are reground while still on the card by driving the revolving flats (4) around the path and simultaneously spinning the grinding wheel and traversing the wheel laterally across the bare flats. The combined motions of the wheel and the flats result in a regrinding of the points which closely resembles the optimum regrinding pattern.

10 Claims, 5 Drawing Sheets

REVOLVING FLATS CLEANING BRUSHING AND RESHARPENING APPARATUS IN A CARDING MACHINE

This application claims priority under 35 USC §119 and/or §365 to U.K. Patent Application No. 0317402.6 filed in the United Kingdom on Jul. 24, 2003, the entire contents of which is hereby incorporated by reference.

FIELD OF THE INVENTION

This invention concerns a device used for cleaning, brushing and grinding the wires of revolving flats in-situ in any carding machine.

BACKGROUND

In the process of spinning yarn, a carding machine comes second in the sequence of spinning processes. Carding is undertaken mainly to disentangle fibers, intensively clean fibers by removing impurities and short fibers and to form a sliver to facilitate further processing. A prior art carding machine is illustrated in FIG. 1 together with an enlarged side view of a revolving flat in FIG. 1A. The carding machine mainly comprises three rotatable cylinders of different sizes and known as the licker-in 1, the main cylinder 2 and the doffer 3. A number of revolving flats 4 are mounted to travel around an endless path 5 positioned above the main cylinder 2. A saw tooth wire 6 is wound on to the surface of the main cylinder to form closely packed coils, so that the teeth extend radially from and substantially cover the circumferential surface of the main cylinder 2. The other cylinders are similarly wound with a saw toothed wire.

Wire staples are pressed through a flexible foundation to form the fine flexible wire teeth 4*b* of a flat top. Each flat top is mounted on a flat bar 4*d* known as a "bare flat" to form a "revolving flat 4" covered with the fine flexible wire teeth 4*b*. The end 4*c* of the wire projecting from the flexible foundation is bent in the intended direction of motion of the revolving flats. The tip of each tops wire is ground to a point. The path of the revolving flats 4 envelopes a part of the circumferential surface of the main cylinder 2 so that during the processing the material passes through a small gap between tops wire points and the teeth projecting from the main cylinder 2. The circumferential area of the main cylinder 2 covered by the revolving flat 4' is known as the carding area. The angular direction of the wire points on the main cylinder 2 and the wire points on on the revolving flats are always kept opposite to each other in the carding area, so as to perform the carding action.

During processing of fibers in the carding machine, fibers are taken from a feed in small tufts by the licker-in 1. These tufts subsequently get transferred onto the main cylinder 2 in the form of a fine fleece. This fine fleece of fibers undergoes carding action between the teeth on the main cylinder and the revolving flats. During this intensive opening and cleaning operation the revolving flats being flexible start getting clogged with debris and the short fiber present in the fine fleece. Normally the revolving flats move in the same direction as that of main cylinder 2. As each revolving flat 4' moves out of the carding area it is cleaned, so that a clean revolving flat 5 can re-enter the carding area to perform consistent carding action.

It has been observed that when the direction of the movement of the revolving flat is opposite to that of the main cylinder better carding action takes place. Hence this arrangement known as a "reverse flat movement system" is incorporated in the latest generation of high production cards. The fibers thus carded are collected by the doffer 3, which are later taken away to form a sliver.

As the extent of cleanliness of the revolving flats greatly influences consistent carding action, different types of cleaning system both mechanical and manual are in use. Different types of flat top cleaning mechanisms are provided by carding machine manufacturers to remove the short fibers deposited on the surface of the revolving flats and impurities clogged in the flat tops in the form of a fleece called flat strips.

The cleaning problem is more accentuated in cards with a reverse flat movement mechanism. The market demand to improve the carding process and its production leads to a demand for the use of a reverse flat movement and other improvements in the machine. However, existing revolving flat cleaning devices do not operate satisfactorily on a reverse flat movement mechanism.

With the processing of materials in the carding machine the tips of the wires in the revolving flats start wearing. To maintain consistent quality output the wire points must be reground. During the grinding process the worn out portion in the flat wire tips are cut off to provide a sharp front edge on the wire points for effective carding.

Conventionally a roller covered with either emery fillet or a full width grinding stone is used to undertake the grinding operation of flat tops. When flat tops are ground using conventional grinders there is always an increase in the land area on the wire tip. This increase of land area becomes more prominent with subsequent grindings. The increase of land area causes deterioration in the efficiency of the tops due to reduced holding capacity of fibers by the wire tops.

SUMMARY

The present invention aims to provide apparatus for cleaning and grinding revolving flats which alleviates the technical problems expressly or implicitly discussed above.

Accordingly the present invention provides a flat top cleaning and grinding apparatus in combination with a carding machine in which revolving flats are conveyed around an endless path to envelope a part of the circumferential surface of a main cylinder comprising:

a precision feeding system supporting a guide track to extend laterally across the span of a revolving flat in the endless path of the carding machine, a carriage supporting a wheel drive to rotatably drive the wheel around an axis perpendicular to the direction of motion of the revolving flats, said carriage being mounted on a guide track and driven to reciprocally traverse the width of a revolving flat, said wheel drive being able to interchangeably drive either one of a cleaning wheel and a grinding wheel, whereby the wheel can be driven in rotation and traversed across the width of each revolving flat, one at a time, as the revolving flats are conveyed around the path, said precision feeding system providing means to precisely adjust the height of the guide track above the revolving flat so that when fitted with a cleaning wheel the wheel acts to clean down to the flexible surface of the revolving flat during normal operation of the carding machine and, when the grinding wheel is substituted for the cleaning wheel, the height of the grinding wheel above the revolving flat can be precisely adjusted so that as the grinding wheel spins and the carriage traverses the revolving flat while the revolving flats are conveyed around the path, the points of the wires are accurately reground.

Preferably the wheel drive supports the wheel spaced perpendicularly from the longitudinal axis of the guide track to provide for convenient exchange of the wheel on the wheel drive. Convenient exchange of the wheel is further aided by mounting the wheel on a projecting unobstructed end of a drive shaft. The drive shaft may project from an independent motor supported on a support strut depending from the carriage.

Preferably the cleaning wheel can take the form of an annular brush wherein the bristles of the brush are preferably coated with or have embedded in them fine abrasive particles which enhance the cleaning effect of the brush.

In use each revolving flat progresses out of the carding area and is then engaged by the cleaning wheel. The carriage causes the wheel to traverse reciprocally across the span of the revolving flat so extracting fouling from between the wire teeth. Sensors control the length of the stroke of the carriage to be compatible with the main cylinder and tops.

As this brush on the moving head traverse along the full length of the device, the total length of the tops gets thoroughly cleaned. This system of cleaning allows cleaning of both the wire tips as well as the sides of the wire points. Hence this system provides a mechanical solution to allow the tops running continuously free of any impurities clogged or stuck to its surface.

To undertake grinding operation the abrasive brush wheel is replaced by a wheel having any type of abrasive coating. A calculated predetermined load is applied by the wheel on the wire points. Unlike the conventional grinding stone the grinding load is applied on a smaller area of the tops with the help of a sensitive feeding device. Instead of plain cutting of wire tips and creating a land on the tip, the back portion of the wire is ground and resharpened to a pointed tip very similar to the original shape of the wire points. This is achieved using the precision feeding system which may comprise, a pair of laterally spaced precision slides which support the guide track, each precision slide being supported by a screw support able to displace the guide track vertically with an accuracy of the order of 0.025 mm. A gross motion lift assembly is also provided to lift the guide track clear of the revolving flats for substitution of the wheel and adjustment of the precision slides.

It will be appreciated that the same apparatus is used for cleaning the revolving flats and regrinding the wire tips. This is itself an economic advantage over known wire tops cleaning apparatus or grinding apparatus which can only be used for one or other of these operations. The revolving flats cleaning and grinding apparatus further allows the revolving flats to be cleaned right down to the surface of the revolving flat by accurate adjustment of the operating height of the wheel using the precision feeding mechanism.

The carriage is preferably traversed using a drive such as a linear drive so that the speed of traverse is wholly independent of the speed of the bare tops or the wheel. Also the wheel may be spun by a wheel drive motor so that its speed and direction of rotation are independent of either the carriage speed and direction or the speed of the tops. These adaptations allow the apparatus when running as a cleaning apparatus to clean the revolving flats down to the surface of the revolving flats and to simultaneously polish the wires while ensuring that the whole of the revolving flat is cleaned during each pass around the path to maintain excellent production quality.

The independence of the carriage traverse and the wheel drives allows the speed of the carriage and wheel to be adjusted as appropriate to the grinding operation.

BRIEF DESCRIPTION OF THE DRAWINGS

A flat top cleaning and grinding apparatus constructed in accordance with the present invention will now be described, by way of example only, with reference to the accompanying illustrative drawings; in which, FIG. 1 shows a prior art carding machine and FIG. 1A shows an enlarged view of a revolving flat.

DETAILED DESCRIPTION

Figure 1:
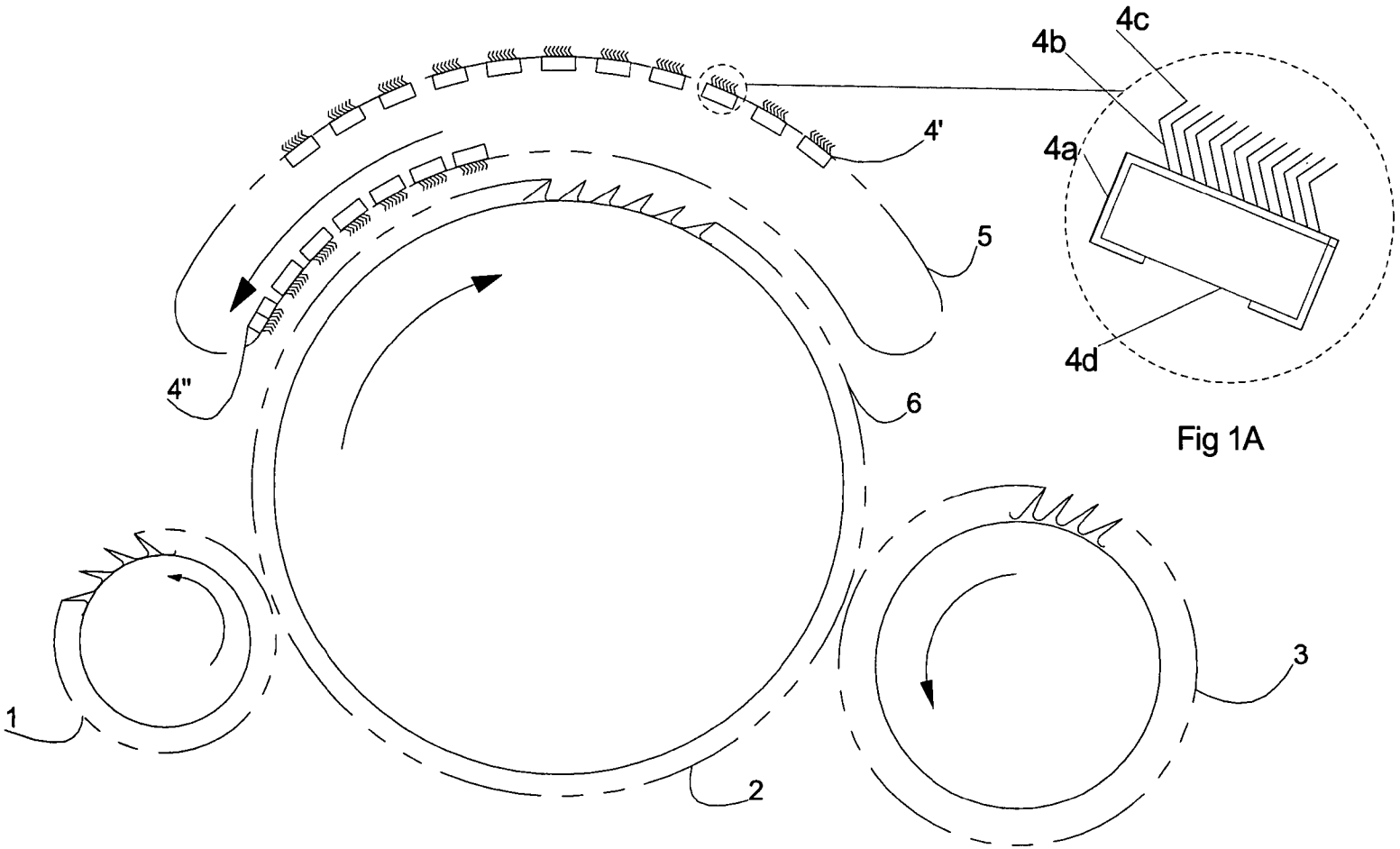
Figure 2:
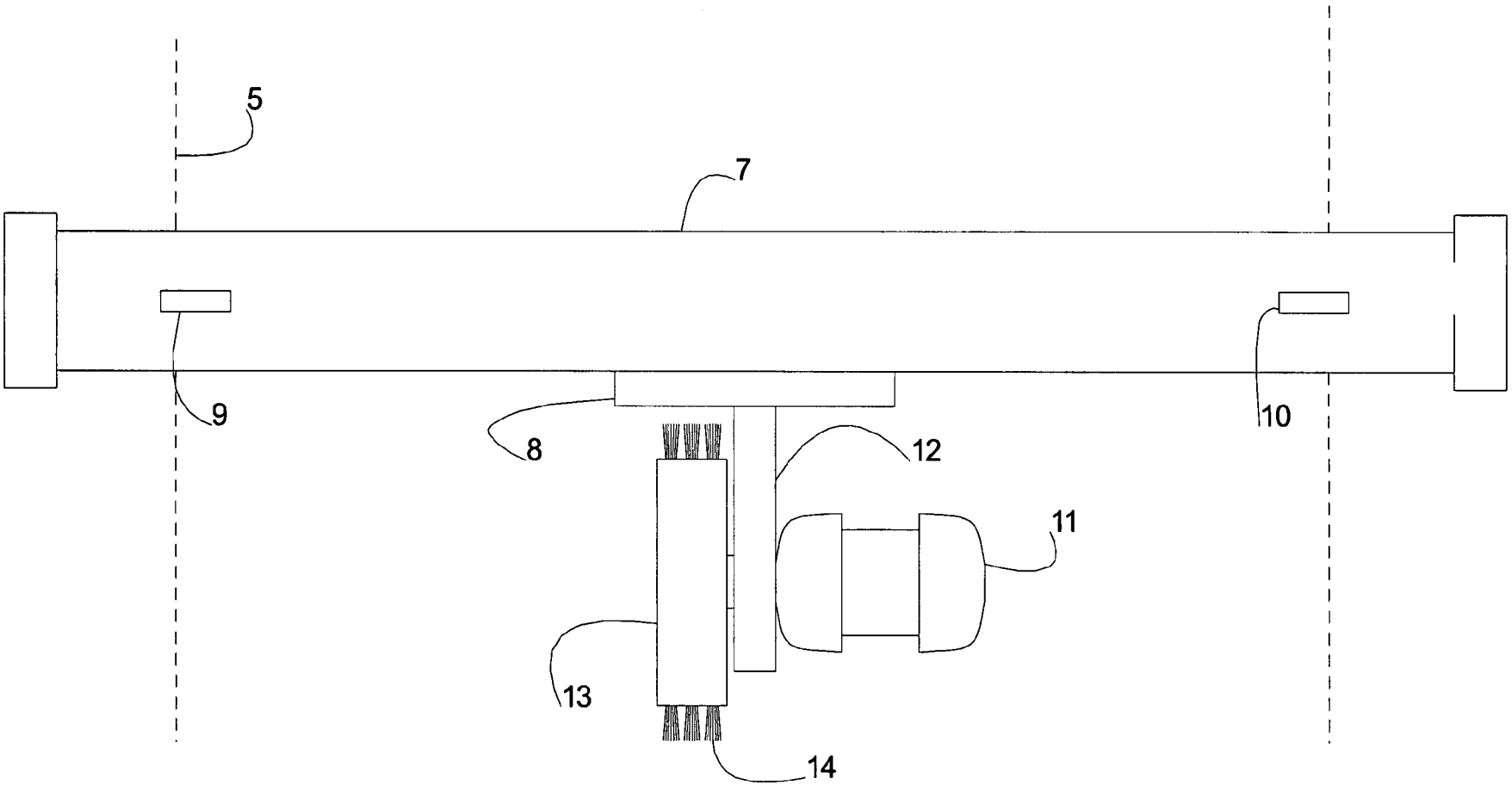
FIG. 2 shows a diagrammatic view of the apparatus equipped with a brush wheel.
Figure 3:
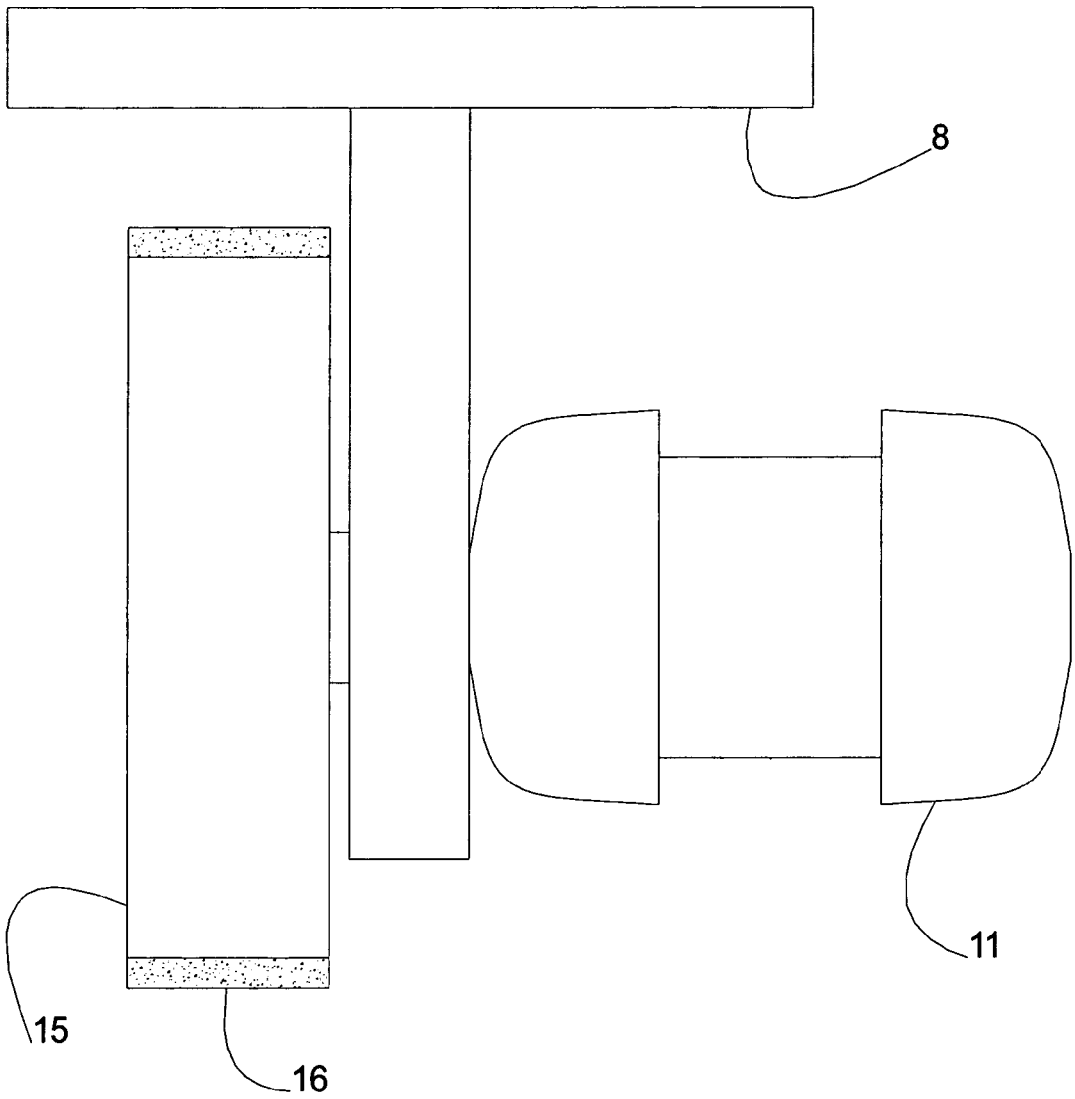
FIG. 3 shows a diagrammatic view of part of the apparatus showing the carriage equipped with a grinding wheel.
Figure 4:
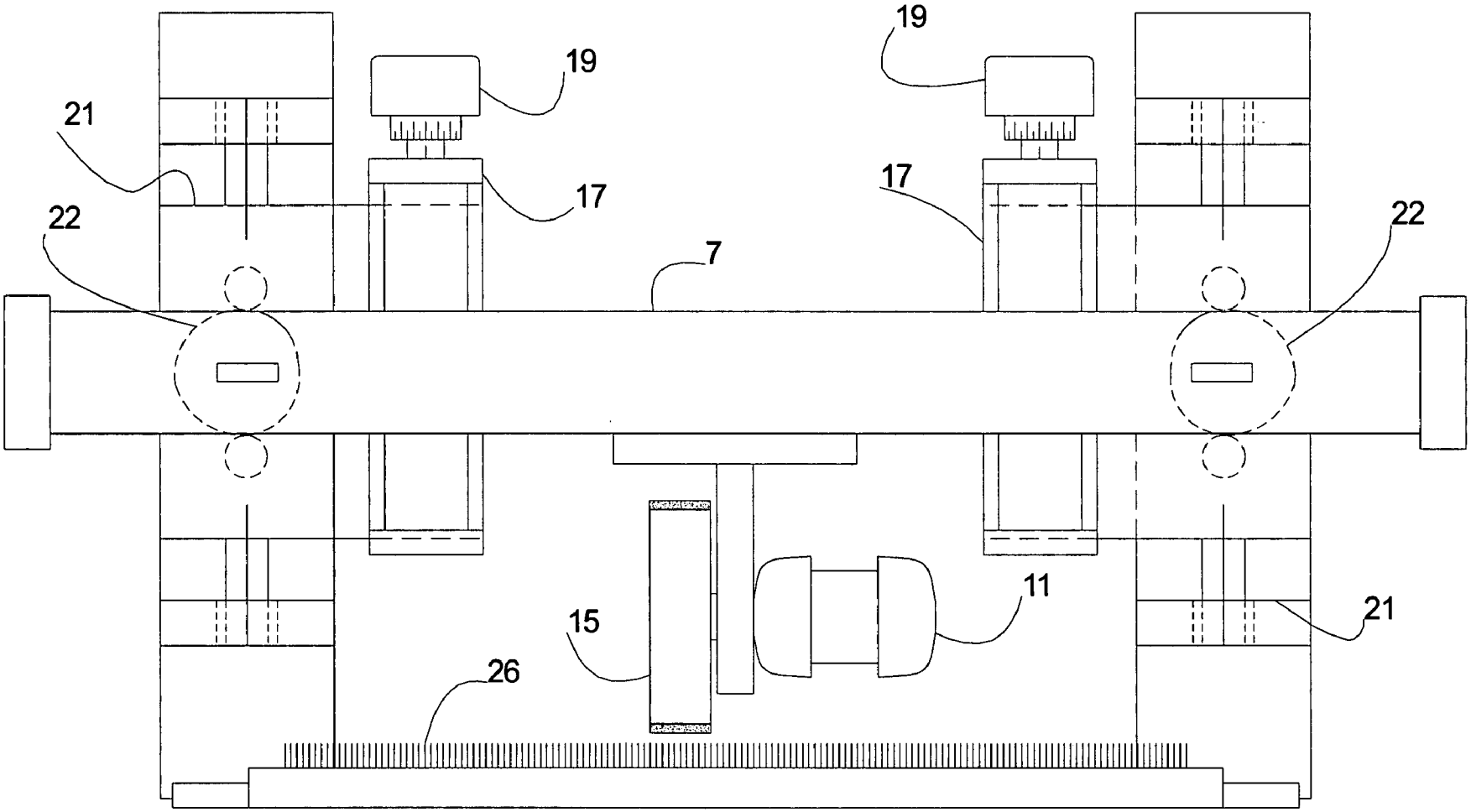
FIG. 4 is a front elevation of the apparatus adapted for grinding the revolving flats on a card.

The apparatus comprises a support structure shown in detail in FIG. 4 which is able to support a guide track 7 so that it is able to extend across the width of the path of the revolving flats 4 as they are conveyed around the path 5. In FIG. 2 the path 5 is notionally shown in broken lines. A carriage 8 is mounted upon the track 7 and provided with a linear propulsion drive which can cause it to travel the length of the track between the sensor 9 and the sensor 10 at a speed independent of the speed of the revolving flats 4 and which can therefore be adjusted for optimal cleaning or grinding operation.

The carriage 8 supports a motor drive 11 on a mounting 12 to be spaced perpendicularly from the longitudinal axis of the guide track 7. The mounting consists of a support strut on to which the motor drive 11 is mounted. A drive shaft projects from the motor drive 11 to mount either one of a rotary brush 13 or a grinding wheel 15 to spin about an axis extending laterally of the path of the revolving flats 4. The axle projects to present an unobstructed end for convenient exchange of the rotary brush or grinding wheel when required. The length of the guide track is sufficient to bring the cleaning brush or grinding wheel into respective cleaning or grinding engagement with all the wires in each revolving flat.

The annular brush 13 consists of tufts of bristles 14, each tuft being arranged in a ring around a hub of the brush equally spaced from an end of the brush. In the illustration three rings of tufts are shown. The bristles of the brush have abrasive particles such as emery embedded in them. In use the brush 13 is spun at high speed (e.g., 1400 rpm) relative to the speed of the tops passing beneath it and located to engage with an underlying top so that the bristles of the brush scour the fouling from between the wire teeth of the revolving flat as it passes beneath. The carriage is driven reciprocally across the width of the revolving flat so that effectively the whole surface of the revolving flat is swept by the brush. Thus each revolving flat is swept clean of fouling as it leaves the carding area during a carding process.

The apparatus is used for ONCARD grinding or regrinding the revolving flat wires without removing the revolving flats from the carding machine. A grinding wheel 15 is substituted for the annular brush 13. The grinding wheel has a peripheral cylindrical grinding surface 16 of a width sufficient to span several wires simultaneously as shown in FIG. 4.

The mounting 12 and/or track support is provided with a precision feeding system shown in FIG. 4 whereby the load applied to the grinding wheel 15 as it bears against the revolving flat wires is applied to a small area of the tops wires. In this way a back portion of the wire is ground which therefore maintains a pointed wire tip very similar to the original wire tip point.

Figure 6:
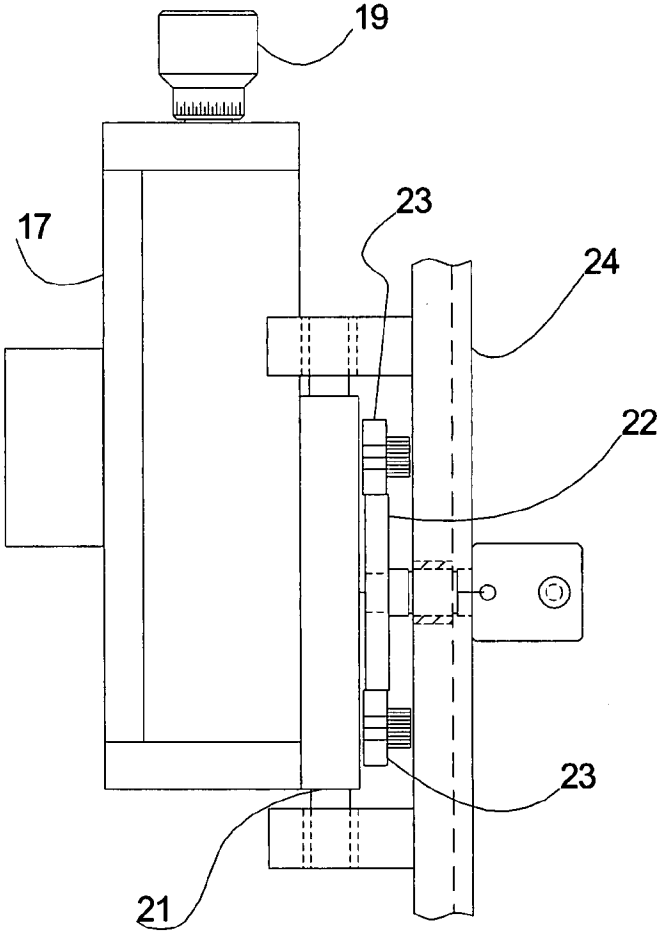
FIG. 6 is a side elevation of the slide support in FIG. 5.
Figure 5:
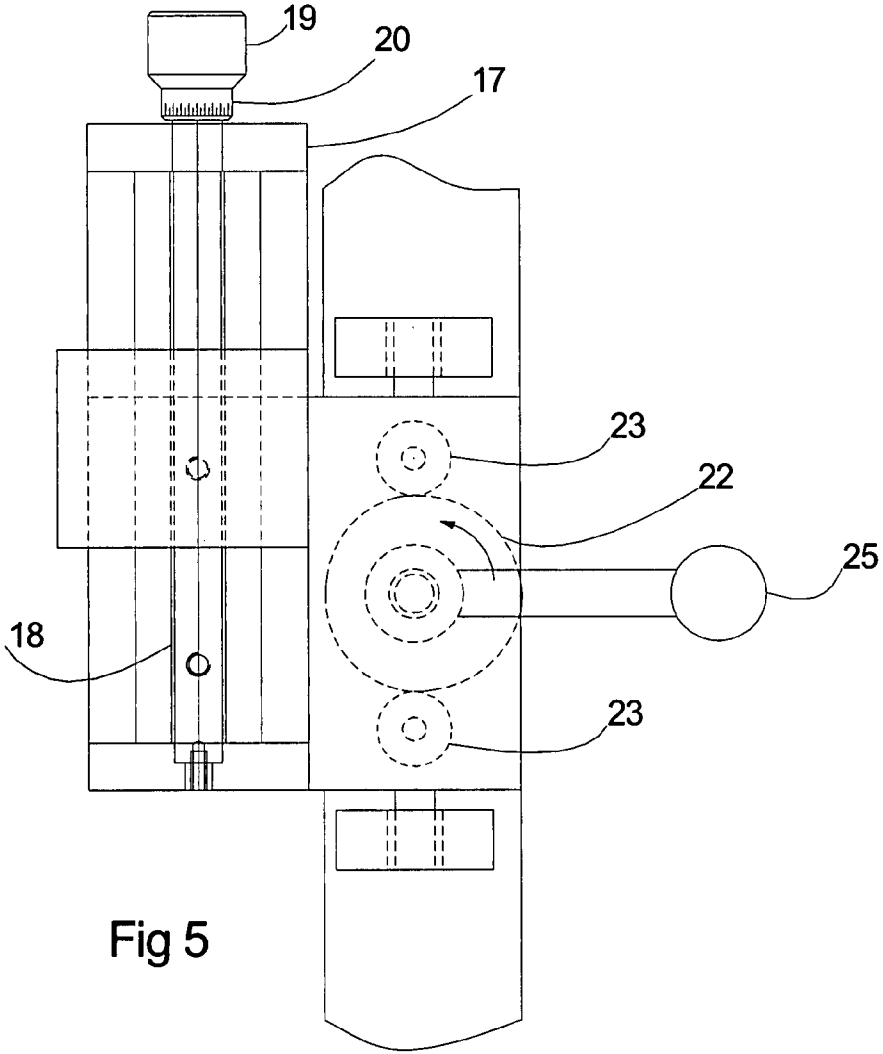
FIG. 5 is a rear elevation of the left hand vertical slide support in FIG. 4.

FIGS. 4, 5 and 6 show a preferred embodiment of a precision feeding system able to apply a grinding wheel 15 to the revolving flat wires with a precise load. The system comprises the guide track 7 which is supported on a pair of laterally spaced vertical slides 17. Each slide has a precision screw support 18 controlled by means of a slide knob 19 provided with a gauge or scale 20 which allows the height of the slide and so the height of the guide track 7 to be adjusted with an accuracy of the order of 0.025 mm.

Each slide is mounted onto an intermediate plate 21 which extends outwards from the slide. Behind each intermediate plate 21 is a rotatably mounted cam 22 coupled to a pair of roller pins 23 which are mounted to a support bracket 24. The cam 22 is coupled to a hand lever 25.

To control the force exerted on the wire tops 26 by the grinding wheel 15 each hand lever 25 is actuated to lift the each slider and hence the guide track 7 to an uppermost position via the action of the cams 22. The rim of the grinding wheel 15 is then gauged to the revolving flat wires by means of a strip gauge. For example, if the maximum throw of the cams is $D=2.5$ mm, and $\delta d=0.05$ mm is to be ground off, then the thickness of the strip gauge is set to 2.45 mm ($D-\delta d$) by actuating the slide knobs to lower the track against the sliders by the amount ($\delta d$). The hand levers 24 are then used to rotate the sliders down to their original position relative to the bracket so that the grinding wheel is now pressed against the wire tops to remove ($\delta d$) material.

What is claimed is:

1. A revolving flat cleaning and grinding apparatus in combination with a carding machine in which revolving flats are conveyed around an endless path to envelope a part of the circumferential surface of a main cylinder comprising:

a precision feeding system supporting a guide track to extend laterally across the span of a revolving flat in the endless path of the carding machine, a carriage supporting a wheel drive to rotatably drive the wheel around an axis perpendicular to the direction of motion of the revolving flat, said carriage being mounted on a guide track and driven to reciprocally traverse the width of a revolving flat, said wheel drive being able to interchangeably drive either one of a cleaning wheel and a grinding wheel, whereby the wheel can be driven in rotation and traversed across the width of each revolving flat, one at a time, as the revolving flats are conveyed around the path, said precision feeding system providing means to precisely adjust the height of the guide track above the revolving flat so that when fitted with a cleaning wheel the wheel acts to clean down to the surface of the revolving flat during normal operation of the carding machine and, when the grinding wheel is substituted for the cleaning wheel, the height of the grinding wheel above the revolving flat can be precisely adjusted so that as the grinding wheel spins and the carriage traverses the revolving flats while the revolving flats are conveyed around the path, the points of the revolving flats are accurately reground.

2. Apparatus according to claim 1 wherein the wheel drive supports the wheel spaced perpendicularly from the longitudinal axis of the guide track to provide for convenient exchange of the wheel on the wheel drive.

3. Apparatus according to claim 1 wherein the wheel is mounted on a projecting unobstructed end of a drive shaft.

4. Apparatus according to claim 3 wherein the drive shaft projects from a motor supported on a support strut depending from the carriage.

5. Apparatus according to claim 1 wherein the cleaning wheel comprises an annular brush.

6. Apparatus according to claim 5 wherein the bristles of the brush have abrasive surfaces.

7. Apparatus according to claim 6 wherein the bristles have abrasive particles embedded in them to provide an abrasive surface.

8. Apparatus according to claim 7 wherein sensors are provided to reverse the traverse of the carriage when it reaches the side edge of a revolving flat.

9. Apparatus according to claim 1 wherein the precision feeding system comprises, a pair of laterally spaced precision slides which support the guide track, each precision slide being supported by a screw support able to displace the guide track vertically with an accuracy of the order of 0.025 mm and a gross motion lift assembly to lift the guide track clear of the revolving flats for substitution of the wheel and adjustment of the precision slides.

10. Apparatus according to claim 1 wherein the grinding wheel has a peripheral cylindrical grinding surface of a width sufficient to span several wires simultaneously.

* * * * *